US007603050B2

(12) United States Patent
Kim

(10) Patent No.: US 7,603,050 B2
(45) Date of Patent: Oct. 13, 2009

(54) COOLING APPARATUS AND IMAGE FORMING DEVICE HAVING THE COOLING APPARATUS

(75) Inventor: Myoung-jin Kim, Incheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 231 days.

(21) Appl. No.: 11/517,431

(22) Filed: Sep. 8, 2006

(65) Prior Publication Data

US 2007/0116489 A1 May 24, 2007

(30) Foreign Application Priority Data

Nov. 18, 2005 (KR) ..... 10-2005-0110954

(51) Int. Cl.
*G03G 15/20* (2006.01)
*G03G 21/20* (2006.01)

(52) U.S. Cl. ..... 399/92; 399/91; 399/94; 399/122; 399/320

(58) Field of Classification Search ..... 399/91, 399/92, 94, 122, 320
See application file for complete search history.

(56) References Cited

U.S. PATENT DOCUMENTS 3,941,471 A * 3/1976 Schatka et al. ..... 399/91
5,047,798 A * 9/1991 Yamamoto et al. ..... 355/405
5,164,778 A * 11/1992 Tanabe et al. ..... 399/9
5,749,039 A * 5/1998 Thomas ..... 399/397
6,173,132 B1 * 1/2001 Kida et al. ..... 399/44
6,219,504 B1 * 4/2001 Matsuzaki et al. ..... 399/92
6,259,871 B1 * 7/2001 Rider et al. ..... 399/92
6,327,447 B1 * 12/2001 Nakano et al. ..... 399/92
6,356,722 B1 * 3/2002 Kida ..... 399/92
6,438,339 B1 8/2002 Kaiho
6,510,299 B2 * 1/2003 Baughman ..... 399/92
6,611,667 B2 * 8/2003 Kaiho ..... 399/92

(Continued)

FOREIGN PATENT DOCUMENTS

JP 61-213867 9/1986

(Continued)

*Primary Examiner*—David M Gray
*Assistant Examiner*—G. M. Hyder
(74) *Attorney, Agent, or Firm*—Roylance, Abrams, Berdo & Goodman, L.L.P.

(57) ABSTRACT

A cooling apparatus and an image forming device having the cooling apparatus are provided. The cooling apparatus includes an induction opening formed at an outer frame to draw the air into the image forming device, an air duct disposed adjacent to a fixing roller in a longitudinal direction thereof, the fixing roller being heated by a heating source therein, and a blower disposed between the induction opening and the air duct to send the air into the air duct from the induction opening. The cooling apparatus moves the air longitudinally along a jam cover disposed adjacent to the fixing roller, and discharges it to the outside. Accordingly, temperatures in the image forming device and of the components therein can be prevented from overheating and being abnormally increased due to a heat emitted from the heating source. As a result, it is possible not only to prevent a performance of the image forming device from deteriorating due to the abnormal increase in the temperatures in the image forming device and of components therein, but also to prevent a user from getting burned due to the jam cover heated by the heat from the heating source during a jam removing.

29 Claims, 6 Drawing Sheets

U.S. PATENT DOCUMENTS

| | | | | |
|---|---|---|---|---|
| 6,771,917 | B2 * | 8/2004 | Kaiho | 399/92 |
| 6,885,836 | B2 * | 4/2005 | Kimura et al. | 399/91 |
| 6,922,538 | B2 | 7/2005 | Kimura | |
| 6,999,697 | B2 * | 2/2006 | Kaiho | 399/92 |
| 7,003,242 | B2 * | 2/2006 | Kida | 399/92 |
| 7,024,129 | B2 * | 4/2006 | Adachi | 399/92 |
| 7,110,694 | B2 * | 9/2006 | Ito | 399/92 |
| 7,149,453 | B2 * | 12/2006 | Fujita | 399/92 |
| 2003/0053818 | A1 * | 3/2003 | Kimura | 399/94 |

FOREIGN PATENT DOCUMENTS

| | | |
|---|---|---|
| JP | 11-231760 | 8/1999 |
| JP | 2001-34141 | 2/2001 |
| JP | 2004-340988 | 12/2004 |
| JP | 2005-99880 | 4/2005 |
| KR | 10-2004-0085184 | 10/2004 |

* cited by examiner

COOLING APPARATUS AND IMAGE FORMING DEVICE HAVING THE COOLING APPARATUS

CROSS-REFERENCE TO RELATED APPLICATIONS

This application claims the benefit under 35 §U.S.C. 119 (a) of Korean Patent Application No. 10-2005-110954 filed in the Korean Intellectual Property Office on Nov. 18, 2005, the entire disclosure of which is hereby incorporated by reference.

BACKGROUND OF THE INVENTION

1. Field of the Invention

The present invention relates to an image forming device such as a laser printer, a multifunctional machine, a copier or the like. More particularly, the present invention relates to a cooling apparatus that directs cooling air into an image forming device to maintain suitable temperatures in the image forming device and the components such as a photoconductive body, a developing device, a jam cover, and/or an optical part of scanner therein. The invention is also directed to an image forming device having the cooling apparatus.

2. Description of the Related Art

Generally, an electrophotographic image forming device has a printer unit that prints a required image onto a recording medium such as a sheet of printing paper through a series of image forming processes. The image forming processes comprise a charging process, a light-exposing process, a developing process, a transfer process, and a fusing process.

A fusing part of the printer unit fuses and presses a developer image transferred onto the recording medium to fix the image thereon during the fixing process, thereby obtaining a required permanent image. The fusing part has a fixing roller, and a pressing roller. The fixing roller is heated by a heating source such as a halogen lamp installed therein, and the pressing roller is pressed against the fixing roller by an elastic or spring pressing device to apply a pressure to the recording medium. The fixing roller and the pressing roller are covered up by a jam cover. The jam cover is hinged, so that when a jam is generated between the fixing roller and the pressing roller, it can be opened to remove the jam.

The fixing roller is usually heated to maintain a temperature of about 165° C. during a print standby mode, and at a temperature of about 180° C. during a printing mode. Therefore, a heat which is emitted from the fixing roller may cause temperatures of components such as a photoconductivity body, a developing part and the like as well as a temperature in the image forming device to abnormally increase, thereby deteriorating a performance of the image forming device.

In particular, since the jam cover is located directly adjacent to the fixing roller, its temperature may be increased by more than about 70° C. after the recording media are continuously printed and discharged. Accordingly, when a user contacts the jam cover to remove a jam generated between the fixing roller and the pressing roller during a printing, it is possible for the user to be burned due to the jam cover heated.

Also, if the electrophotographic image forming device has a copying function as in a multifunctional machine, a copier and the like, it further comprises a scanner unit that scans a document to print or store data scanned from the document.

The scanner unit is usually disposed directly above a stack of the printer unit to which the recording medium is discharged, at the uppermost part of the image forming device. Accordingly, the scanner unit is directly subjected to a heat emitted from the fixing roller of the fusing part and the recording medium that is discharged to the stack via the fusing part. Particularly, the scanner unit is provided with optical parts such as a mirror and a lens and the like, electronic parts such as a CCD module and the like, and precision parts requiring an evenness such as a rack gear on which the CCD module is moved, and the like. Therefore, an increase in the temperature of the scanner unit results in a thermal deformation of the optical parts, the electronic parts, and the precision parts, thereby deteriorating a performance of the scanner unit.

To prevent the temperatures of the components and the jam cover of the printer unit and/or the scanner unit from increasing due to the heat from the fixing roller as described above, a blowing cooling apparatus that directs the air into the printer unit and/or the scanner unit by force may be considered to be applied to the image forming device. In this case, a fan is installed outside the printer unit to which the jam cover is located, and/or at outside the scanned unit. However, the blowing cooling apparatus is effective to decrease the temperature of the jam cover and/or the scanner unit to and/or into which the air is sent, but may cause heat from the jam cover to be transferred to peripheral parts such as the photoconductive body, the developing part and the like in the vicinity of the jam cover by the air around the jam cover, thereby increasing temperatures of the peripheral parts. The air may cause dust and the like to flow into the scanner unit through the air opening into the scanner unit, thereby contaminating the optical parts in the scanner unit. Further, in the blowing cooling apparatus, when air pressure in the printer unit and/or the scanner unit reaches a certain level, the air does not flow into the printer unit and/or the scanner unit, although the fan runs idle, thereby generating a noise.

Another method to prevent the temperatures of the components and the jam cover of the printer unit and/or the scanner unit from increasing due to the heat from the fixing roller, a discharge or suction apparatus that sends an air in the printer unit and/or the scanner unit outside the printer or scanner may be considered. In this case, a fan is installed in the printer unit in the vicinity of a portion thereof where the jam cover is located, and/or in the scanned unit. However, the discharge apparatus has a disadvantage that only the jam cover of the printer unit and/or the portion of the scanner unit to which the fan is installed is cooled, since only air in the vicinity of the jam cover of the printer unit and/or the portion of the scanner unit where the fan is installed is sent to the outside of the printer unit and/or the scanner unit. Also, in the scanner unit having the optical parts, dust and the like may flow into the scanner unit through an opening for sending the air in the scanner unit to the outside thereof, thereby contaminating the optical parts in the scanner unit to deteriorate a performance thereof.

SUMMARY OF THE INVENTION

Accordingly, the present invention has been made to solve the above-mentioned problems. An object of the present invention is to provide a cooling apparatus that is configured to move the air longitudinally along a vicinity of a fixing roller and then to discharge the air to the outside, thereby preventing overheating and excessive temperatures in the image forming device and of components such as a photoconductive body, a jam cover and the like therein due to heat emitted from a heating source of the fixing roller. The invention is also directed to an image forming device having the cooling apparatus.

Another object of the present invention is to provide a cooling apparatus that is configured to move the air longitudinally along a vicinity of a fixing roller and then to discharge the air to the outside via a scanner unit, thereby preventing a temperature in the scanner unit from being increased due to a heat emitted from a heating source of the fixing roller. The invention is also directed to an image forming device having the same.

In order to achieve the above-mentioned objects, according to an aspect of the present invention, a cooling apparatus is provided for use in an image forming device having an outer frame. The cooling apparatus comprises an induction opening formed at the outer frame to introduce the air into the inside of the image forming device, an air duct disposed adjacent to a fixing roller and extending in a longitudinal direction with respect to the fixing roller, the fixing roller being heated by a heating source therein, and a blower disposed between the induction opening and the air duct to send the air into the air duct from the induction opening.

The induction opening may be formed at a side cover of the outer frame.

The air duct may comprise an inlet disposed opposite to the induction opening to draw in the air introduced through the induction opening, and an outlet disposed to guide the air toward a stack of a recording medium to be discharged, the outlet having an air flowing direction different from that of the inlet.

Alternatively, if the image forming device has a copying function, the air duct may comprise an inlet disposed opposite to the induction opening to draw in the air introduced through the induction opening, and an outlet disposed to guide the air first toward an lower surface of a scanner unit disposed above a stack of a recording medium to be discharged, and then toward the stack, the outlet having an air flow direction different from that of the inlet. In this case, it is preferable that the outlet be formed at an upper surface of the air duct, and have a plurality of blades disposed to be inclined at an angle.

Particularly, the air duct may comprises a first part installed at a middle frame which pivotally supports a jam cover for removing a jam between the fixing roller and a pressing roller thereby to allow the jam cover to be opened or closed, and having the inlet, and a second part integrally formed with the jam cover to be separable from the first part when the jam cover is opened to remove the jam, and having the outlet. At this time, the second part may comprise a wall with a surface to close up a space formed by an upper surface and a lower guide surface of the jam cover, the lower guide surface guiding a movement of the recording medium.

In addition, it is preferable that the outlet of the air duct have a cross section larger than that of the inlet of the air duct or the induction opening.

The blower may comprise a blowing fan, which draws the air through the induction opening and sends the air into the air duct to flow therethrough.

According to another aspect of the present invention, an image forming device is provided comprising a main body having an outer frame, a fusing unit having a fixing roller which is heated by a heating source, and a pressing roller to press a recording medium to the fixing roller, and a cooling unit to prevent temperatures in the image forming device and of components therein from overheating by heat emitted from the heating source. The cooling unit comprises an induction opening formed at the outer frame to introduce the air into the image forming device, an air duct disposed adjacent to a fixing roller and extending in a longitudinal direction thereof, the fixing roller being heated by a heating source therein, and a blower disposed between the induction opening and the air duct to send the air into the air duct from the induction opening.

The induction opening may be formed at a side cover of the outer frame.

The air duct may comprise an inlet disposed opposite to the induction opening to draw in the air introduced through the induction opening, and an outlet disposed to guide the air toward a tray or stack of a recording medium to be discharged, the outlet having an air flow direction different from that of the inlet.

Alternatively, if the image forming device has a copying function, the air duct may comprise an inlet disposed opposite to the induction opening to draw in the air introduced through the induction opening, and an outlet disposed to guide the air first toward an lower surface of a scanner unit disposed above a stack of a recording medium to be discharged, and then toward the stack, the outlet having an air flow direction different from that of the inlet. In this case, it is preferable that the outlet is formed at an upper surface of the air duct, and has a plurality of inclined blades.

The image forming device of the invention may further include a jam cover to remove a jam between the fixing roller and the pressing roller, the jam cover being pivotally installed at a middle frame to open or close a nip between the fixing roller and the pressing roller. In this embodiment, it is preferable that the air duct comprises a first part installed at the middle frame, and has the inlet, and a second part integrally formed with the jam cover separable from the first part when the jam cover is opened to remove the jam, and having the outlet. The second part may comprise a surface to close up a space formed by an upper surface and a lower guide surface of the jam cover, the lower guide surface guiding a movement of the recording medium.

In addition, it is preferable that the outlet of the air duct has a cross section larger than that of the inlet of the air duct or the induction opening.

The blower may comprise a blowing fan, which draws or blows the air through the induction opening and sends the air into and through the air duct.

These and other aspects of the invention will become apparent from the following detailed description of the invention which, in conjunction with the annexed drawings, disclose various embodiments of the invention.

BRIEF DESCRIPTION OF THE DRAWINGS

The above aspects and features of the present invention will be more apparent from the description for certain embodiments of the present invention taken with reference to the accompanying drawings, in which.

DETAILED DESCRIPTION OF THE PREFERRED EMBODIMENTS

Hereinbelow, a cooling apparatus and an image forming device having the same according to an exemplary embodiment of the present invention will now be described in detail with reference to accompanying drawings.

Figure 1:
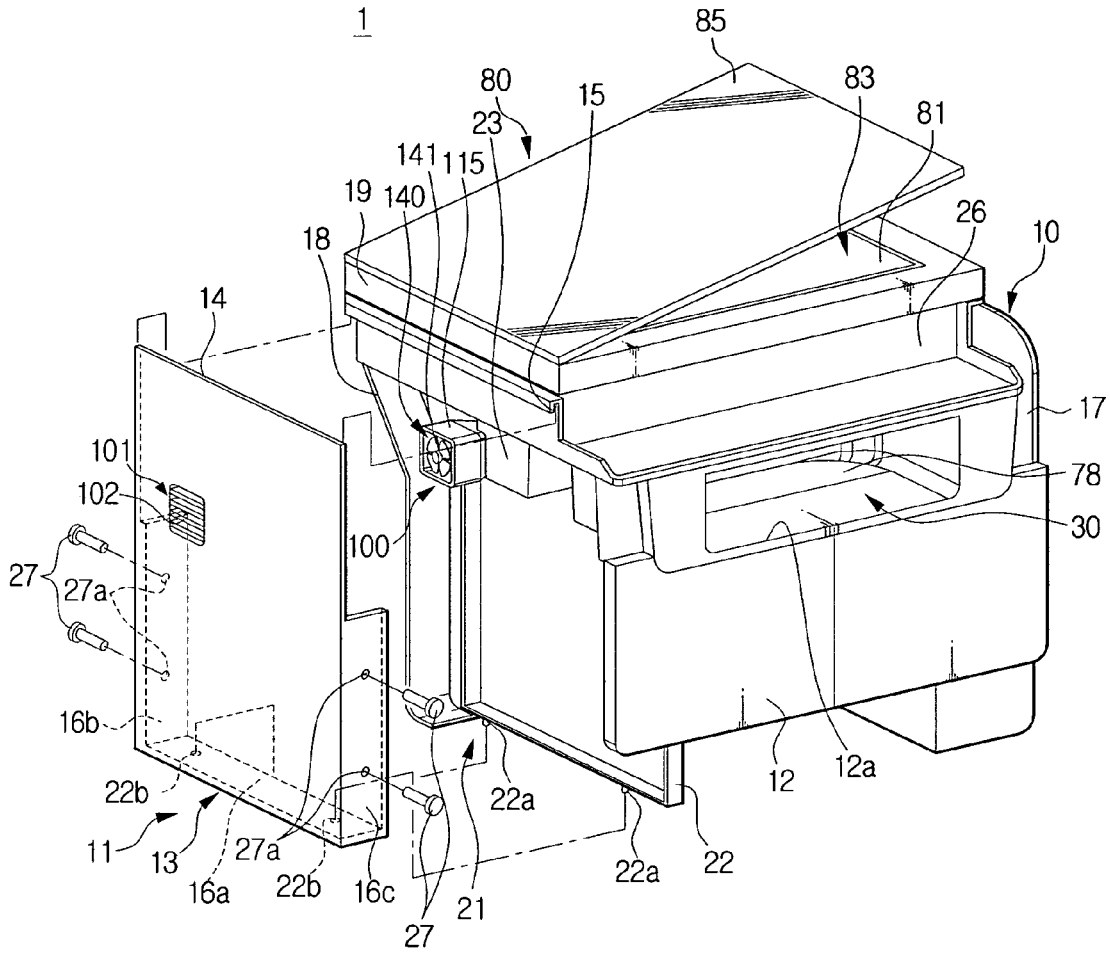
FIG. 1 is a partial exploded, perspective view exemplifying a multifunctional machine having a cooling apparatus in accordance with the present invention.

FIG. 1 schematically illustrates an image forming device to which a cooling apparatus in accordance with the present invention is applied.

The image forming device of the present invention is a multifunctional machine 1 having a printing function that prints data input from an external device such as a personal computer (PC) or the like, and a copying function that scans a document and/or prints data scanned from the document.

As illustrated in FIG. 1, the multifunctional machine 1 includes a main frame 10, a printer unit 30 to print data input from the external device such as the PC or the like, and a scanner unit 80 to scan a document to print data scanned from the document.

The main frame 10 has an outer frame 11, and an inner frame 21.

The outer frame 11 is provided with a front cover 12, first and second side covers 13 and 17, a rear cover 18, and an upper cover 19. An upper edge 14 of the first side cover 13 is inserted in a slot 15 formed at a side of a lower portion of the upper cover 19, and a lower surface 16*a* of the first side cover 13 is fixed to a printer frame 22 of the inner frame 21 by fixing holes 22*b* which receives fixing projections 22*a*. The fixing projections 22*a* are formed at a bottom of the printer frame 22. At both side surfaces 16*b* and 16*c* of the first side cover 13 are formed screw holes 27*a* in which screws 27 are inserted and fastened. The front cover 12 is formed with a discharge opening 12*a* to discharge a recording medium P such as a sheet of printing paper from a tray or stack 78. The stack 78 keeps the recording medium P discharged from the printer unit 10 after printing.

The inner frame 21 is provided with a printer frame 22, a scanner frame 26, and a middle frame 23. The printer frame 22 and the scanner frame 26 mounts components of the printer unit 30 and the scanner unit 80 therein, respectively. The middle frame 23, which is located between the printer frame 22 and the scanner frame 26, forms the tray or stack 78 to hold the printed recording medium P.

Figure 2:
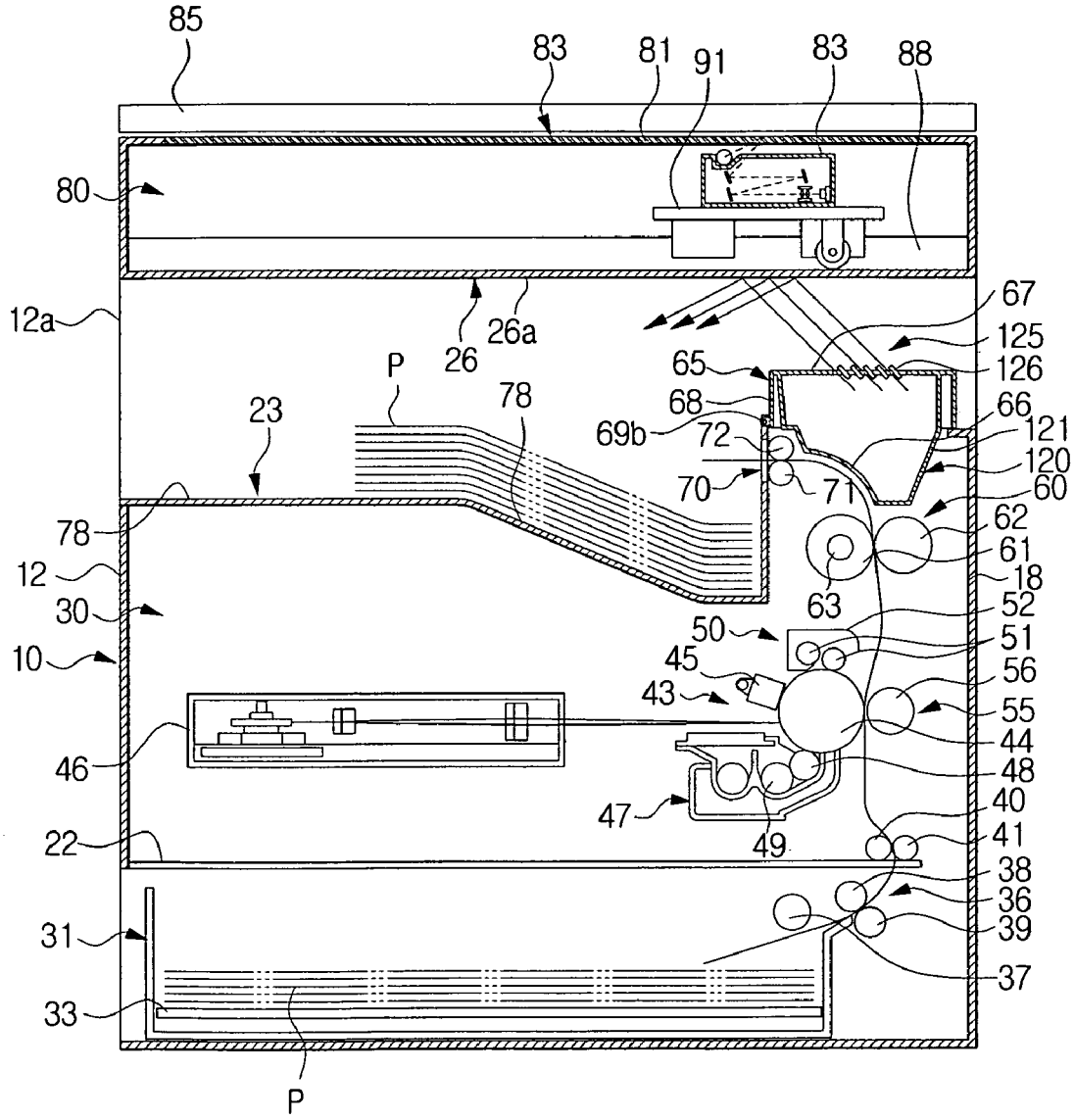
FIG. 2 is a schematic side elevation view of the multifunctional machine illustrated in FIG. 1.

As illustrated in FIG. 2, the printer unit 30 includes a medium cassette 31, a pickup and feed part 36, an image forming part 43, a transfer part 55, a fusing part 60, and a medium discharge part 70.

The medium cassette 31, which is detachably installed under the printer frame 22, supports the recording medium P to be elastically movable up and down through a pressing plate 33 supported by an elastic spring (not shown) therein.

The pickup and feed part 36 is disposed above a rear portion of the medium cassette 31 to pick up and feed the recording medium P loaded in the medium cassette 31 sheet by sheet.

The pickup and feed part 36 is provided with a pickup roller 37 to pick up the recording medium P loaded in the medium cassette 31, and a first and second conveyance rollers 38 and 40 and first and second backup rollers 39 and 41 to feed the picked-up recording medium P to the image forming part 43.

The image forming part 43 has a photoconductive body 44 in the shape of a drum, which is continuously rotated in a direction by a photoconductive body driving source (not shown) such as a motor.

A charger 45, a laser scanning part 46, a developing part 47 in which a developer such as a toner is contained, a transfer part 55, and a cleaner 50 are disposed at predetermined positions of an outer circumference of the photoconductive body 44 in a rotation direction.

The charger 45 is a scrotron charger, which uniformly charges a surface of the photoconductive body 44. The laser scanning part 46 irradiates laser beams in the shape of axial lines toward the surface of the photoconductive body 44 charged by the charger 45 by using a light source such as a laser diode, according to an image signal input from the external device such as the PC or the like, and thereby forms an electrostatic latent image for a developer image.

The developing part 47 is provided with a developing roller 48, a supplying roller 49, and a developer regulation member or blade (not shown). The developing roller 48, which is disposed to face the photoconductive body 44 with a constant gap therebetween, attaches a developer to the electrostatic latent image formed on the surface of the photoconductive body 44 to develop into a developer image. The supplying roller 49 supplies the developing roller 48 with the developer. The developer regulation blade regulates the thickness of a developer layer formed on the developing roller 48.

The transfer part 55 is provided with a transfer roller 56, which transfers the developer image formed on the surface of the photoconductive body 44 onto the recording medium P.

The transfer roller 56 supplies a predetermined level of transfer voltage to the recording medium P to transfer the developer image from the surface of the photoconductive body 44 onto the recoding medium P.

The cleaner 50 removes a waste developer remaining in the surface of the photoconductive body 44 after the developer image is transferred from the photoconductive body 44 onto the recoding medium P. The cleaner 50 is provided with a plurality of cleaning rollers 51 and a storage case 52 for waste developer.

The fusing part 60 fuses and compresses the developer image transferred onto the recording medium P with a heat and a pressure to fix it thereon. The fusing part 60 comprises a fixing roller 61 and a pressing roller 62. The fixing roller 61 heats the developer image to fuse and fix it on the recording medium P. For this, the fixing roller 61 has a heater 63 such as a halogen lamp disposed as a heating source therein. The pressing roller 62 is pressed against the fixing roller 61 by an elastic pressing device (not shown) to give a pressure to the recording medium P.

Figure 5:
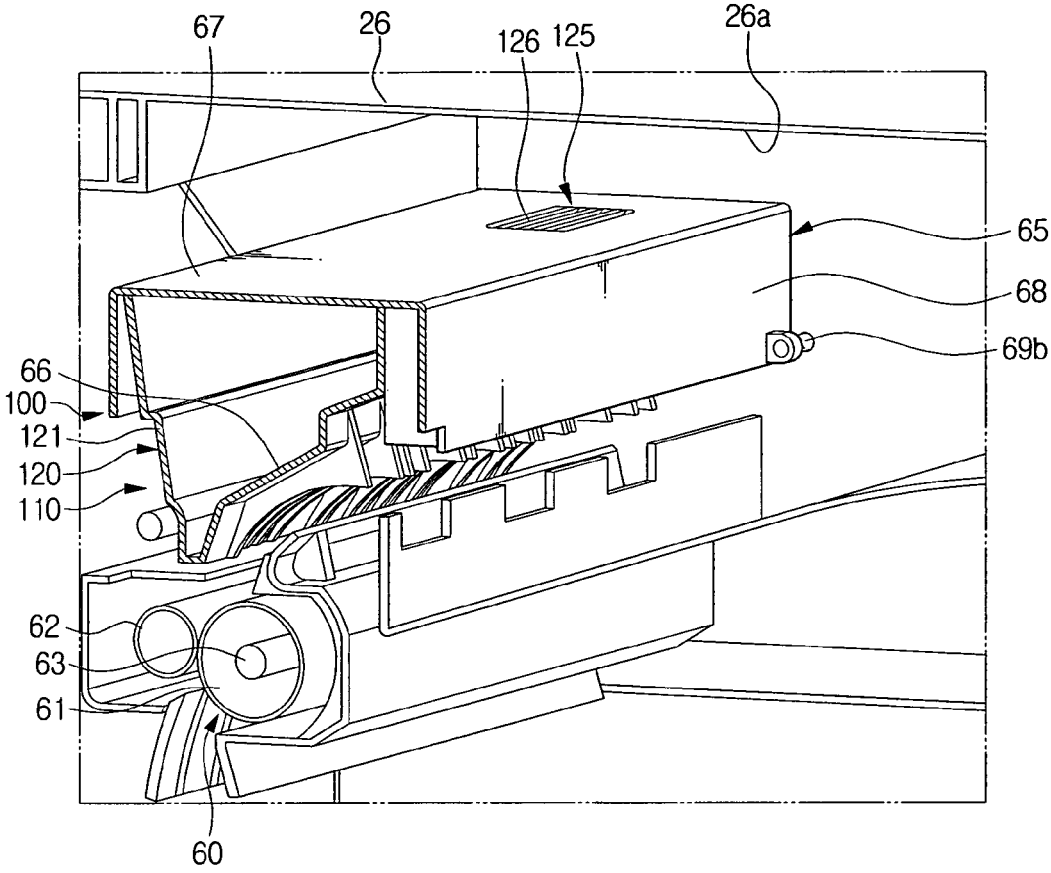
FIG. 5 is a perspective view taken along line I-I of FIG. 3.

Above a nip between the fixing roller 61 and the pressing roller 62 is disposed a jam cover 65. The jam cover 65 at a lower portion thereof has a guide surface 66 to guide the recording medium P, on which the developer image is fixed by the fixing roller 61 and the pressing roller 62, to the medium discharge part 70. As illustrated in FIG. 5, the guide surface 66 together with the upper surface 67 forms a second part 120 of an air duct 110, which is described later.

Figure 3:
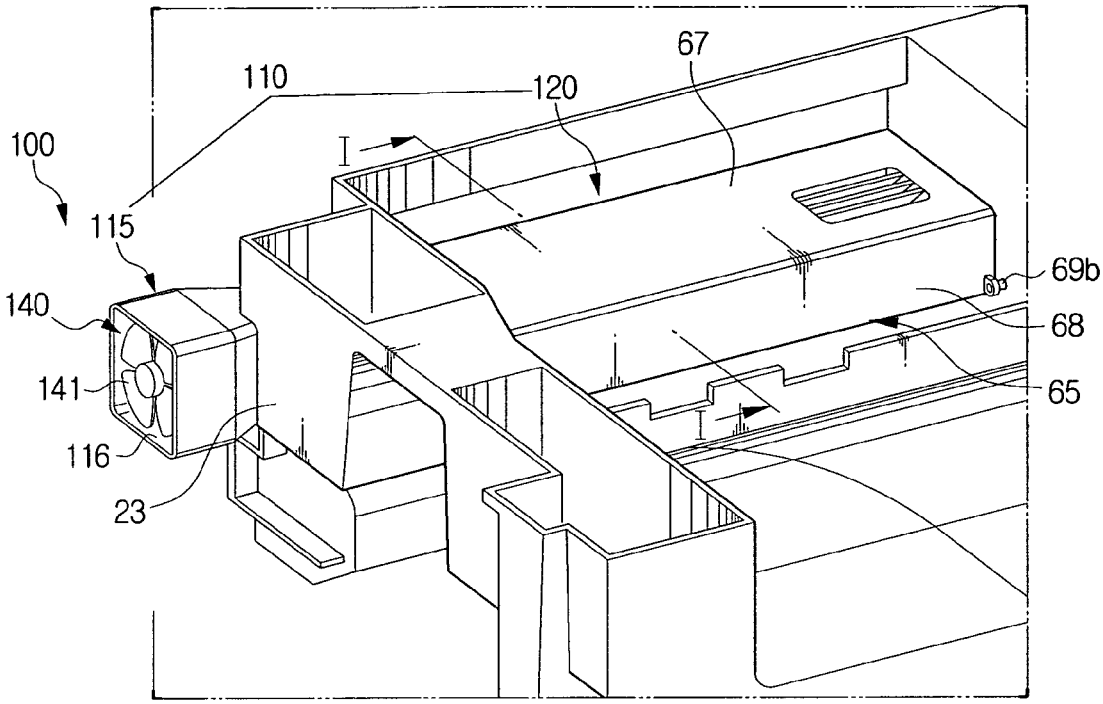
FIG. 3 is a partial perspective view showing the cooling unit of the multifunctional machine illustrated in FIG. 1.

Further, the jam cover 65 is installed at the middle frame 23. The jam cover 65 is hinged on the middle frame 23 by first and second hinges 69*a* and 69*b* (see FIGS. 3 through 5) to open or close the nip between the fixing roller 61 and the pressing roller 62. The first and second hinges 69*a* and 69*b* are formed at both sides of a front surface 68 of the jam cover 65. Accordingly, if a jam is generated between the fixing roller 61 and the pressing roller 62, the jam cover 65 is rotated in a counterclockwise direction of FIG. 2 about the first and second hinges 69*a* and 69*b*, and thereby the nip between the fixing roller 61 and the pressing roller 62 is opened, so that the jam therebetween can be removed.

The medium discharge part 70 discharges the recording medium P where the developer image is fixed to the outside. The medium discharge part 70 is provided with a discharge roller 71, a backup roller 72, and a tray or stack 78. The discharge roller 71 and the backup roller 72 are rotatably fixed to the middle frame 23. The stack 78 is formed on the middle frame 23 at a downstream end of the discharge roller 71 and the backup roller 72 in a medium feeding direction.

Referring again to FIGS. 1 and 2, the scanner unit 80 is a flat bed type scanner, which is installed above the middle frame 23 over the printer unit 30.

Figure 6:
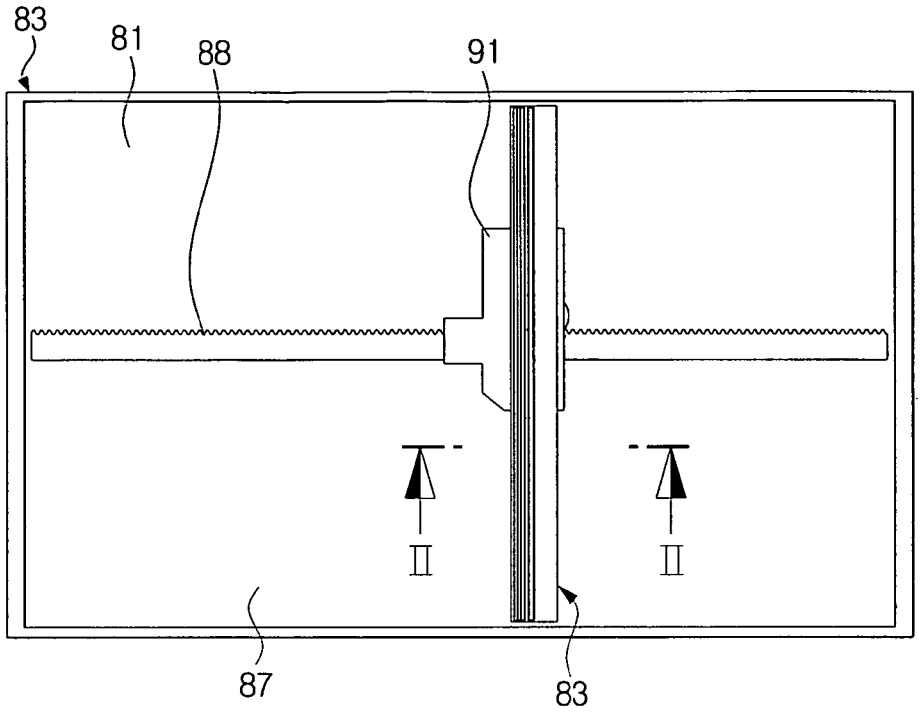
FIG. 6 is a top plan view exemplifying a scanner unit of the multifunctional machine illustrated in FIG. 1.
Figure 7:
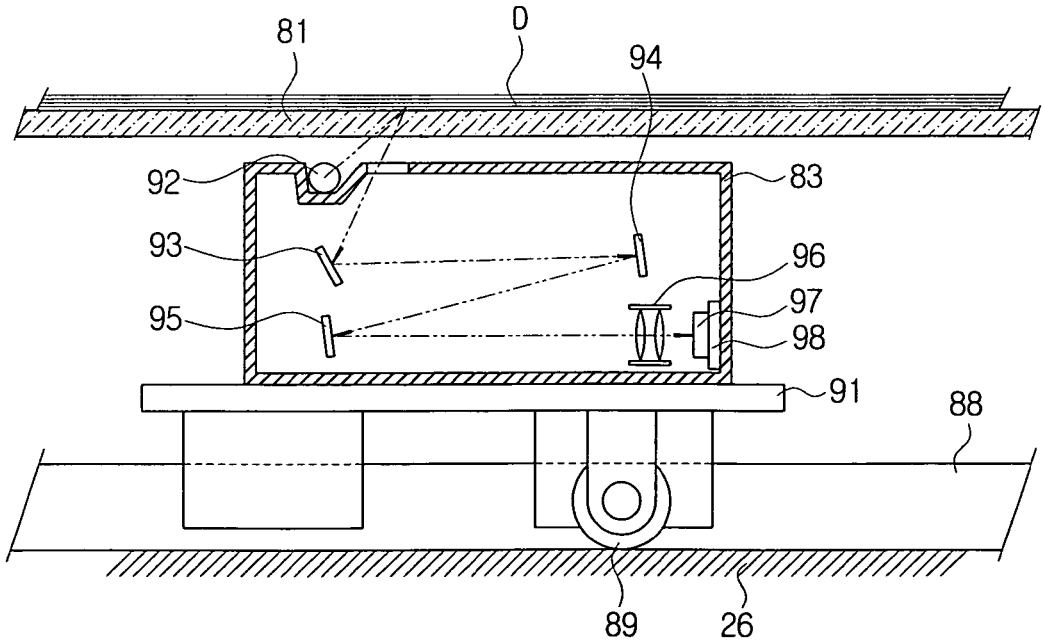
FIG. 7 is a partial cross sectional view taken along line II-II of FIG. 6.

As illustrated in FIGS. 6 and 7, the scanner unit 80 includes a flat bed 83 having a glass plate 81, on which a document D is laid, and a document cover 85 (see FIGS. 1 and 2) for immovably securing the document D laid on the glass plate 81.

A scanning module 83 for scanning a document D is installed within the flat bed 83 below the glass plate 81.

Below the scanning module 83 are installed a scanner motor (not shown) and a fixing plate 91. A guide roller 89 is fixed to the fixing plate 91.

The scanner motor drives the scanning module 83 forward and rearward when the document D laid on the glass plate 81 is scanned. The scanner motor 134 includes a drive shaft (not shown) with a drive gear (not shown) provided at one end thereof. The drive gear is meshed with a rack gear 88 provided on the bed frame 87.

The guide roller 89 guides the scanning module 83 to move along the bed frame 87 when the scanning module 83 is moved forward and rearward by the drive gear meshed with the rack gear 88.

A lamp 92 for illuminating light on the document D laid on the glass plate 81 is installed within the scanning module 83. A first mirror 93 for reflecting the light reflected from the surface of the document D with recorded data is installed under the lamp 92. The first mirror 93 is tilted to a predetermined angle.

At a side of the first mirror 93, a second mirror 94 is installed to reflect the light reflected by the first mirror 93 in a given angle toward a third mirror 95, wherein the third mirror 95 is located below the first mirror 93 to reflect the light from the second mirror 94 to a lens 96 for focusing the light. At a side of the lens 96, there is provided a CCD (charge coupled device) sensor 97 on a CCD board 98 for converting the focused light into an electric energy, i.e., a voltage.

Referring to FIGS. 2 through 5, a cooling unit 100 is disposed with respect to the jam cover 65 disposed adjacent to the fixing roller 61 in the middle frame 23 to prevent temperatures in the multifunctional machine 1 and of components therein from overheating or being abnormally increased due to a heat emitted from the heater 63 of the fixing roller 61.

The cooling unit 100 comprises an induction opening 101 (see FIG. 1), an air duct 110, and a blower 140.

As illustrate in FIG. 1, the induction opening 101 is formed at the first side cover 13 of the outer frame 11 to draw the air into the multifunctional machine 1. A plurality of first blades 102 or louvers are provided at the induction opening 101. The first blades 102 are disposed to be inclined at a predetermined angle, so that a dust and the like are prevented from being drawn in through the induction opening 101.

The air duct 110 is disposed longitudinally to the jam cover 65 in the middle frame 23 to guide the air drawn in through the induction opening 101 along the jam cover 65.

Figure 4:
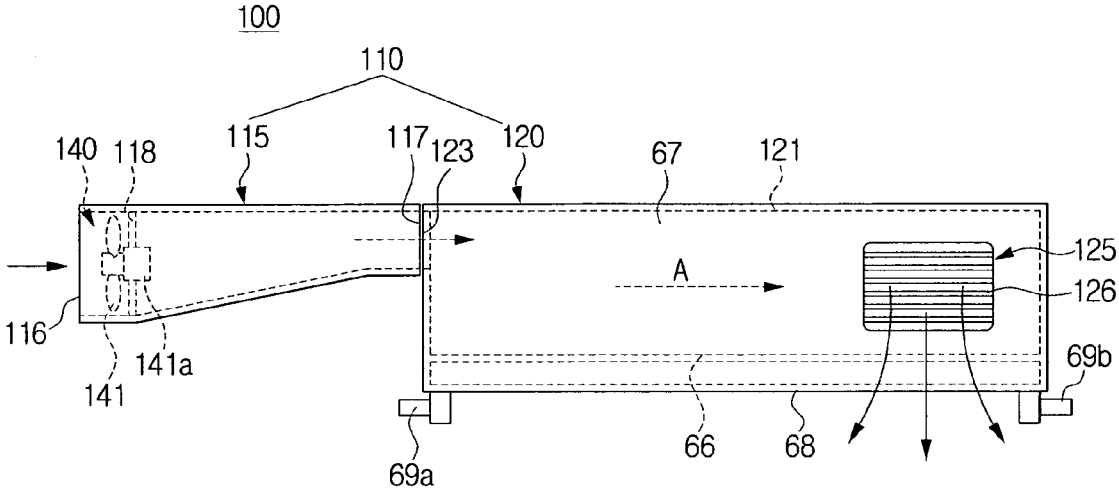
FIG. 4 is a top plan showing the cooling unit of the multifunctional machine illustrated in FIG. 3.

As illustrated in FIGS. 4 and 5, the air duct 110 is first and second parts 115 and 120, respectively.

The first part 115 is installed in the middle frame 23, which rotatably supports the jam cover 65 by the first and second hinges 69*a* and 69*b*. The first part 115 has an inlet 116 disposed opposite to the induction opening 101 to draw in the outer air through the induction opening 101.

As illustrated in FIG. 5, the second part 120 is provided with a wall having a surface 121 to close the space formed between an upper surface 67 and a lower guide surface 66 of the jam cover 65. The lower guide surface 66 guides the movement of the recording medium P.

Accordingly, when the jam cover 65 is rotated about the first and second hinges 69*a* and 69*b* and opened to remove a jam, the second part 120 is separated from the first part 115.

Also, the second part 120 has a second connecting opening 123, and an outlet 125. The second connecting opening 123 is mated and communicated with a first connecting opening 117 disposed at an opposite end of the first part 115 where the inlet 116 is located. The outlet 125 is disposed at a right side (FIGS. 3 through 5) of the upper surface 67 of the jam cover 65, so that the air flows in an air flow direction different from that of when it is drawn through the second connecting opening 123. In the example shown, an air flow direction exiting the outlet 125 which executes a 90-degree turn from the air flow direction through the second part 120.

Particularly, as illustrated in FIG. 2, a plurality of second blades 126 or louvers is preferably installed at the outlet 125 of the second part 120. The second blades 126 are disposed to be inclined at a predetermined angle of, for example, 45°, so that the air is guided first toward a lower surface 26*a* of the scanner frame 26 disposed above the stack 78, and then toward the stack 78.

Further, between the first and second parts 115 and 120, that is, the first and second connecting openings 117 and 123 is preferably formed a gap to leak a portion of the air passing through. Accordingly, when the outer air passes through the first and second parts 115 and 120 by the blower 140 to be described later, a portion of the air can flow into the printer unit 30 through the gap between the first and second connecting openings 117 and 123, so that components such as the photoconductive body 44, the developing part 47 and the like in the printer unit 30 can be additionally cooled.

Also, the outlet 125 of the second part 120 preferably has a cross section larger than that of the inlet 116 of the first part 115 or the induction opening 101. In this case, when the air is drawn into the air duct 110 through the induction opening 101 by the blower 140, it does not stagnate and generate a pressure in the first and second part 115 and 120, but easily passes and discharges through the outlet 125.

Accordingly, even though the portion of the air drawn into the air duct 110 flows into the printer unit 30 through the gap between the first and second connecting openings 117 and 123, it is not excessive, so that it does not cause heat from the heater 63 of the fixing roller 61 to transfer to the other components such as the photoconductive body 44, the developing part 47 and the like.

The blower 140 sends the air into the air duct 110 from the induction opening 101. The blower 140 is disposed in the first part 115 between the induction opening 101 and the first part 115 of the air duct 110. The blower 140 can comprise a blowing fan 141 with wings formed to draw the air through the induction opening 101 and then to send the air into the air duct 110 thereby to flow therethrough.

As illustrated in FIG. 4, a motor part 141*a* of the blowing fan 141 is fixed on the fixing plate 118, which has air-flowing openings (not shown) formed therein. The motor part 141*a* is connected to a blowing fan driving circuit (not shown), which is controlled by a controller (not shown).

Here, although the motor part 141*a* is illustrated and explained as being formed separately from the fixing plate 118 and fixed thereto, it may be configured as a single part formed integrally with the fixing plate 118, and installed in the first part 115.

As described above, the cooling unit 100 of the present invention draws in the air through the induction opening 101 by the blower 141, moves it longitudinally along the jam cover 65 disposed adjacent to the fixing roller 61, and then discharges it to the outside. Accordingly, temperatures in the multifunctional machine 1 and of the components, for example, the photoconductivity body 44, the developing part 47 and the like therein can be prevented from overheating and being abnormally increased due to heat emitted from the heater 63 of the fixing roller 61, so that the components are maintained at appropriate temperature levels. As a result, it is possible not only to prevent deterioration of the performance of the multifunctional machine 1 due to the abnormal increase in the temperatures in the multifunctional machine 1 and of the components therein, but also to prevent a user from getting burned due to the jam cover 65 being heated by the heat emitted from the heater 63 while removing the jam.

Also, the cooling unit 100 of the present invention does not send the air into the scanner unit 80 by force or send air in the scanner unit 80 to an outside thereof, but moves the air longitudinally along the jam cover 65 disposed adjacent to the fixing roller 61, and then discharges it via a lower portion of the scanner unit 80, that is, the lower surface 26*a* of the scanner frame 26, to the outside. Accordingly, a temperature in the scanner unit 80 can be prevented from overheating and being abnormally increased due to the heat emitted from the heater 63 of the fixing roller 61 and/or a heat emitted from the recording medium P discharged to the tray or stack 79 to be stagnated between the stack 78 and the lower surface 26*a* of the scanner frame 26, so that it are maintained in an appropriate level. As a result, it is possible to prevent optical parts such as the scanner module 82 and the like, electronic parts such as the CCD sensor 97 and the CCD board 98, and precision parts such as the rack gear 88 requiring an evenness from being deformed due to the abnormal increase in the temperature of the scanner unit 80, and the like, thereby preventing a performance of the scanner unit 80 from deteriorating. Further, the cooling unit 100 of the present invention is configured without an opening for sending the air into the scanner unit 80 or sending the air in the scanner unit 80 to the outside thereof. Accordingly, it is possible to prevent dust and the like from being drawn into the scanner unit 80 through the opening, thereby preventing the optical parts such as the scanner module 82 from being contaminated to deteriorate the performance of the scanner unit 80.

According to experiments of the applicant, in the multifunctional machine 1 in which the cooling unit 100 of the present invention is installed, temperatures of the jam cover 65, the photoconductive body 44 and the lower surface 26*a* of the scanner frame 26 after the recording media 26 are continuously discharged were about 41° C., about 45° C., and about 50° C., respectively, whereas in the conventional multifunctional machine in which the cooling unit 100 of the present invention is not installed, they were about 70° C., about 48° C., and about 68° C., respectively.

Hereinbefore, exemplified and described above as an appliance, to which the cooling apparatus of the present invention is applied, is a multifunctional machine 1 comprising a scanner unit 80 having a copying function. However, the present invention is not limited to this. For example, a cooling apparatus of the present invention can be employed to a printer (not shown) having only the printer unit 30 without the scanner unit 80 in the same construction and principle as described above. In this case, the cooling apparatus, that is, a cooling unit (not shown) of the present invention is configured, so that an outlet (not shown) of the second part 120 of the air duct 110 is not disposed at the upper surface 67 of the jam cover 65, but at the front surface 68 and the guide surface 66 thereof which are located toward the stack 78.

Further, although the cooling apparatus of the present invention as exemplified and described is applied to a multifunctional machine 1 comprising a scanner unit 80 formed of a flat bed type scanner, the present invention is not limited to this. For example, the cooling apparatus of the present invention can be employed to a multifunctional machine (not shown) comprising a scanner unit (not shown) formed of an automatic document feeding type scanner different from the flat bed type scanner; a copier or multifunctional machine (not shown) comprising a scanner unit (not shown) having both a flat bed type scanner and an automatic document feeding type scanner; or a multifunctional machine (not shown) further having a facsimile function.

Now, the operation of the cooling unit 100 of the multifunctional machine 1 in accordance with of the present invention configured as described above is described.

At first, when a print command is issued from the PC and the like, the controller controls respective components of the printer unit 30 to carry out a series of image forming process for forming an image on a recording medium P, and the blowing fan driving circuit to drive the blowing fan 141.

As a result, the air is inhaled into the first part 115 of the air duct 110 installed in the middle frame 23 through the induction opening 101 formed at the first side cover 12. And then, the air moves along the first part 115 and the second part 120 of the air duct 110. The second part 120 is integrally formed with the jam cover 65.

Accordingly, the air flowing along the second part 120 cools the components, which transfers the heat to the jam cover 65 from the heater 63 of the fixing 61.

Also, a portion of the air flows into the printer unit 30 through the gap between the first connecting opening 117 of the first part 115 and the second connecting opening 123 of the second part 120, so that it can additionally cool the components such the photoconductive body 44, the developing part 47 and the like in the printer unit 30. At this time, since the induction opening 101 or the inlet 116 of the first part 115 has a cross section smaller that the outlet 125 of the second part 120, the portion of the air flowing into the printer unit 30 through the gap between the first and second connecting openings 117 and 123 is not excessive. Therefore, even though the portion of the air flows into the printer unit 30, it does not cause a heat emitted from the heater 63 of the fixing roller 61 to transfer to the components such as the photoconductive body 44, the developing part 47 and the like.

Thereafter, the air is turned in an angle of 90° from its stream by the outlet 125 formed at the upper surface 67 of the jam cover 65, and discharged toward the lower surface 26*a* of the scanner frame 26.

At this time, since the second blades 126 are installed in the outlet 125 to be inclined at an angle of 45°, as shown in FIGS. 2 and 4, the air stream is directed toward the stack 78 to which the recording medium P is discharged.

As a result, heat emitted from the heater 63 of the fixing roller 61 and the recording medium P is continuously discharged, to stagnate between the stack 78 and the lower surface 26*a* of the scanner frame 26 is cooled by the air discharged from the outlet 125, and discharged together with the air through the discharge opening 12*a* formed at the front cover 12 to the outside of the multifunctional machine 1.

Accordingly, the scanner unit 80 is not heated by the heat stagnated between the stack 78 and the lower surface 26*a* of the scanner frame 26, but maintained at an appropriate temperate.

According to the present invention as described above, the cooling apparatus and the image forming device having the same move the air longitudinally along the jam cover disposed adjacent to the fixing roller, and then discharge it to the outside. Accordingly, temperatures in the image forming device and of the components, for example, the photoconductivity body, the developing part and the like therein can be prevented from being abnormally increased due to heat emitted from the heating source of the fixing roller. As a result, it is possible not only to prevent a performance of the image forming device from deteriorating due to the abnormal increase in the temperatures in the image forming device and of the components therein, but also to prevent a user from getting burned due to the jam cover heated by the heat emitted from the heating source during the jam removing.

Also, according to the present invention as described above, the cooling apparatus and the image forming device having the same do not send the air into the scanner unit or send air in the scanner unit outside thereof, but move the air longitudinally along the jam cover disposed adjacent to the fixing roller, and then discharge it via a lower portion of the scanner unit to the outside. Accordingly, a temperature in the scanner unit can be prevented from overheating and being abnormally increased due to the heat emitted from the heating source of the fixing roller and/or the heat emitted from the recording medium discharged to the stack. As a result, it is possible to prevent optical parts, electronic parts, and precision parts from being deformed due to the abnormal increase in the temperature of the scanner unit, thereby preventing a performance of the scanner unit from deteriorating. Further, the cooling apparatus and the image forming device having the same are configured without an opening for sending the air into the scanner unit or sending the air in the scanner unit to the outside thereof. Accordingly, it is possible to prevent dust and the like from being drawn into the scanner unit through the opening, thereby preventing the optical parts from being contaminated to deteriorate a performance of the scanner unit.

Although representative embodiment of the present invention has been shown and described in order to exemplify the principle of the present invention, the present invention is not limited to the specific embodiment. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A cooling apparatus for use in an image forming device having an outer frame, comprising:

an induction opening formed in the outer frame to introduce air into the image forming device;

an air duct disposed adjacent a fixing roller and extending in a longitudinal direction with respect to a longitudinal dimension of a fixing roller, the fixing roller being heated by a heating source therein; and a blower disposed between the induction opening and the air duct to direct the air into the air duct from the induction opening, wherein the air duct has a gap through which a portion of the introduced air can leak and where the air duct is pivotally coupled to the image forming device and is separable from the induction opening.

2. The cooling apparatus as claimed in claim 1, wherein the induction opening is formed in a side cover of the outer frame.

3. The cooling apparatus as claimed in claim 1, wherein the air duct comprises:

an inlet disposed opposite to the induction opening to draw in the air introduced through the induction opening; and an outlet disposed to guide the air toward a stack of a recording medium to be discharged, the outlet having an air flow direction different from that of the inlet.

4. The cooling apparatus as claimed in claim 1, wherein the air duct comprises:

an inlet disposed opposite to the induction opening to draw in the air introduced through the induction opening; and an outlet disposed to guide the air first toward a lower surface of a scanner unit disposed above a tray to receive a recording medium discharged from the image forming device, and then toward the stack, the outlet having an air flow direction different from that of the inlet.

5. The cooling apparatus as claimed in claim 3, wherein the outlet is formed at an upper surface of the air duct, and comprises a plurality of inclined blades.

6. The cooling apparatus as claimed in claim 4, wherein the outlet is formed at an upper surface of the air duct, and comprises a plurality of inclined blades.

7. The cooling apparatus as claimed in claim 4, wherein the air duct comprises:

a first part installed at a middle frame pivotally supporting a jam cover for removing a jam between the fixing roller and a pressing roller thereby allowing the jam cover to be opened or closed, and having the inlet; and a second part integrally formed with the jam cover and separable from the first part when the jam cover is opened to remove the jam, and having the outlet.

8. The cooling apparatus as claimed in claim 7, wherein the second part comprises a surface to reduce a space formed between an upper surface and a lower guide surface of the jam cover, the lower guide surface guiding movement of the recording medium.

9. The cooling apparatus as claimed in claim 3, wherein the outlet of the air duct has a cross section larger than that of the inlet of the air duct or the induction opening.

10. The cooling apparatus as claimed in claim 4, wherein the outlet of the air duct has a cross section larger than that of the inlet of the air duct or the induction opening.

11. The cooling apparatus as claimed in claim 1, wherein the blower comprises a blowing fan, which draws the air through the induction opening and sends the air into and through the air duct.

12. The cooling apparatus of claim 1, wherein said air duct defines a cover overlying the fixing roller.

13. The cooling apparatus of claim 1, wherein said air duct is pivotable about a longitudinal dimension of said air duct.

14. A cooling apparatus for use in an image forming device having an outer frame, comprising:

an induction opening formed in the outer frame to introduce air into the image forming device;

an air duct disposed adjacent a fixing roller and extending in a longitudinal direction with respect to a longitudinal dimension of a fixing roller, the fixing roller being heated by a heating source therein; and a blower disposed between the induction opening and the air duct to direct the air into the air duct from the induction opening, wherein the air duct has a gap through which a portion of the introduced air can leak and wherein the air duct comprises:

a first part installed at a middle frame pivotally supporting a jam cover for removing a jam between the fixing roller and a pressing roller thereby allowing the jam cover to be opened or closed, and having the inlet; and a second part integrally formed with the jam cover and separable from the first part when the jam cover is opened to remove the jam, and having the outlet.

15. The cooling apparatus as claimed in claim 14, wherein the second part comprises a surface to reduce a space formed between an upper surface and a lower guide surface of the jam cover, the lower guide surface guiding movement of the recording medium.

16. An image forming device comprising:

a main body having an outer frame;

a fusing part having a fixing roller, which is heated by a heating source, and a pressing roller to press a recording medium to the fixing roller; and a cooling unit to prevent temperatures in the image forming device and of components therein from overheating by heat emitted from the heating source, wherein the cooling unit comprises:

an induction opening formed at the outer frame to introduce the air into the image forming device;

an air duct disposed adjacent to a fixing roller and extending in a longitudinal direction with respect to a longitudinal dimension of the fixing roller, the fixing roller being heated by a heating source therein and the air duct having an inlet disposed opposite to the induction opening to draw in the air inhaled through the induction opening, and an outlet disposed to guide the air toward a tray to which a recording medium is discharged, the outlet having an air flow direction different from that of the inlet and having a cross-section larger than that of the inlet of the air duct or the induction opening; and a blower disposed between the induction opening and the air duct to send the air into the air duct from the induction opening, wherein the air duct has a gap through which a portion of the introduced air can leak.

17. The image forming device as claimed in claim 16, wherein the induction opening is formed at a side cover of the outer frame.

18. The image forming device as claimed in claim 16, wherein the outlet of the air duct has a cross section larger than that of the inlet of the air duct or the induction opening.

19. The image forming device as claimed in claim 16, wherein the air duct comprises:

an inlet disposed opposite to the induction opening to draw in the air inhaled through the induction opening; and an outlet disposed to guide the air first toward a lower surface of a scanner unit disposed above a tray to which a recording medium is discharged, and then toward the stack, the outlet having an air flow direction different from that of the inlet.

20. The image forming device as claimed in claim 19, wherein the outlet is formed at an upper surface of the air duct, and comprises a plurality of inclined blades.

21. The image forming device as claimed in claim 16, wherein the outlet is formed at an upper surface of the air duct, and comprises a plurality of inclined blades.

22. The image forming device as claimed in claim 16, wherein the blower comprises a blowing fan, which draws the air through the induction opening and sends the air into and through the air duct.

23. An image forming device comprising:

a main body having an outer frame;

a fusing part having a fixing roller, which is heated by a heating source, and a pressing roller to press a recording medium to the fixing roller; and a cooling unit to prevent temperatures in the image forming device and of components therein from overheating by heat emitted from the heating source, wherein the cooling unit comprises:

an induction opening formed at the outer frame to introduce the air into the image forming device;

an air duct disposed adjacent to a fixing roller and extending in a longitudinal direction with respect to a longitudinal dimension of the fixing roller, the fixing roller being heated by a heating source therein, the air duct having an inlet disposed opposite the induction opening to draw air from the induction opening and an outlet disposed to guide air toward a tray to which recording medium is discharged, the outlet having an air flow direction different from that of the inlet; and a blower disposed between the induction opening and the air duct to send the air into the air duct from the induction opening, a jam cover to remove a jam between the fixing roller and the pressing roller, the jam cover being pivotally installed at a middle frame to open or close a nip between the fixing roller and the pressing roller, and wherein the air duct comprises a first part installed at the middle frame, and having the inlet, and a second part integrally formed with the jam cover to be separable from the first part when the jam cover is opened to remove the jam, and having the outlet.

24. The image forming device as claimed in claim 23, wherein the second part comprises a surface to close up a space formed by an upper surface and a lower guide surface of the jam cover, the lower guide surface guiding a movement of the recording medium.

25. An image forming device a main body having an outer frame;

a fusing part having a fixing roller, which is heated by a heating source, and a pressing roller to press a recording medium to the fixing roller; and a cooling unit to prevent temperatures in the image forming device and of components therein from overheating by heat emitted from the heating source, wherein the cooling unit comprises:

an induction opening formed at the outer frame to introduce the air into the image forming device;

an air duct disposed adjacent to a fixing roller and extending in a longitudinal direction with respect to a longitudinal dimension of the fixing roller, the fixing roller being heated by a heating source therein; and a blower disposed between the induction opening and the air duct to send the air into the air duct from the induction opening, wherein the air duct has a gap through which a portion of the introduced air can leak and an inlet disposed opposite to the induction opening to draw in the air inhaled through the induction opening and an outlet disposed to guide the air first toward a lower surface of a scanner unit disposed above a tray to which a recording medium is discharged, and then toward the stack, the outlet having an air flow direction different from that of the inlet; and a jam cover to remove a jam between the fixing roller and the pressing roller, the jam cover being pivotally installed at a middle frame to open or close a nip between the fixing roller and the pressing roller, wherein the air duct comprises a first part installed at the middle frame, and having the inlet, and a second part integrally formed with the jam cover to be separable from the first part when the jam cover is opened to remove the jam, and having the outlet.

26. The image forming device as claimed in claim 25, wherein the second part comprises a surface to close up a space formed by an upper surface and a lower guide surface of the jam cover, the lower guide surface guiding a movement of the recording medium.

27. An image forming device comprising:

a main body having an outer frame;

a fusing part having a fixing roller, which is heated by a heating source, and a pressing roller to press a recording medium to the fixing roller; and a cooling unit to prevent temperatures in the image forming device and of components therein from overheating by heat emitted from the heating source, wherein the cooling unit comprises:

an induction opening formed at the outer frame to introduce the air into the image forming device;

an air duct disposed adjacent to a fixing roller and extending in a longitudinal direction with respect to a longitudinal dimension of the fixing roller, the fixing roller being heated by a heating source therein; and a blower disposed between the induction opening and the air duct to send the air into the air duct from the induction opening, wherein the air duct has a gap through which a portion of the introduced air can leak, said air duct is pivotally connected to said image forming device and is separable from said induction opening.

28. The image forming device of claim 27, wherein said air duct defines a cover overlying the fixing roller.

29. The image forming device of claim 27, wherein said air duct is pivotable about a longitudinal dimension of said air duct.

* * * * *

UNITED STATES PATENT AND TRADEMARK OFFICE

CERTIFICATE OF CORRECTION

PATENT NO. : 7,603,050 B2
APPLICATION NO. : 11/517431
DATED : October 13, 2009
INVENTOR(S) : Myoung-jin Kim It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 266 days.

Signed and Sealed this

Fifth Day of October, 2010

David J. Kappos

David J. Kappos
*Director of the United States Patent and Trademark Office*